US008419013B2

(12) United States Patent
Muneyasu et al.

(10) Patent No.: US 8,419,013 B2
(45) **Date of Patent: *Apr. 16, 2013**

(54) SHEET ALIGNING DEVICE AND IMAGE FORMING APPARATUS INCLUDING THE SAME

(75) Inventors: Takayuki Muneyasu, Tokyo (JP); Junji Shirakawa, Tokyo (JP); Yutaka Shoji, Tokyo (JP); Takeshi Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 118 days.

This patent is subject to a terminal disclaimer.

(21) Appl. No.: 11/892,319

(22) Filed: Aug. 22, 2007

(65) Prior Publication Data

US 2008/0054553 A1 Mar. 6, 2008

(30) Foreign Application Priority Data

Aug. 22, 2006 (JP) ..... 2006-225253
Aug. 22, 2006 (JP) ..... 2006-225254

(51) Int. Cl.
*B65H 9/04* (2006.01)

(52) U.S. Cl.
USPC ..... 271/246; 271/227; 271/228; 271/245

(58) Field of Classification Search ..... 271/245, 271/246, 242, 244, 227, 228
See application file for complete search history.

(56) References Cited

U.S. PATENT DOCUMENTS 4,750,853 A * 6/1988 Van Soest et al. ..... 414/789.9
4,984,779 A * 1/1991 Iwasaki ..... 271/227
5,219,159 A * 6/1993 Malachowski et al. ..... 271/228
5,350,169 A * 9/1994 Hiroi et al. ..... 271/213
5,673,911 A * 10/1997 Loftus et al. ..... 271/273

(Continued)

FOREIGN PATENT DOCUMENTS

JP 59-167428 9/1984
JP 63-26653 2/1988

(Continued)

OTHER PUBLICATIONS

Extended Search Report dated Nov. 27, 2007.

(Continued)

*Primary Examiner* — Kaitlin Joerger
*Assistant Examiner* — Ernesto Suarez
(74) *Attorney, Agent, or Firm* — Harness, Dickey & Pierce, P.L.C.

(57) ABSTRACT

A disclosed sheet aligning device includes a sheet conveyance path; a detecting unit configured to detect a side edge of a sheet being conveyed in the sheet conveyance path; a stopper provided on an upstream side of the detecting unit and configured to open/close in such a manner as to allow/prevent passage of the sheet through the sheet conveyance path and to position a leading edge of the sheet being conveyed in the sheet conveyance path; a first conveying unit provided on an upstream side of the stopper, the first conveying unit including a pair of first rollers configured to come in contact with/separate from each other; a second conveying unit provided on an upstream side of the first conveying unit, the second conveying unit including a pair of second rollers configured to come in contact with/separate from each other; and a horizontal movement unit configured to move the pair of first rollers in an axial direction of the first rollers based on a detection result output by the detecting unit.

22 Claims, 7 Drawing Sheets

U.S. PATENT DOCUMENTS

| | | | | |
|---|---|---|---|---|
| 5,741,009 | A | 4/1998 | Kawano et al. | |
| 5,993,369 | A * | 11/1999 | Sekita et al. | 493/420 |
| 6,011,948 | A | 1/2000 | Amano et al. | |
| 6,135,446 | A * | 10/2000 | Thiemann et al. | 271/228 |
| 6,196,147 | B1 * | 3/2001 | Burton et al. | 112/470.16 |
| 6,273,418 | B1 | 8/2001 | Fujikura et al. | |
| 6,318,714 | B1 * | 11/2001 | Beskitt et al. | 271/10.01 |
| 6,585,439 | B2 * | 7/2003 | Johnson et al. | 400/642 |
| 7,722,039 | B2 * | 5/2010 | Shoji et al. | 271/273 |
| 8,213,851 | B2 * | 7/2012 | Shoji et al. | 399/395 |
| 2002/0003333 | A1 | 1/2002 | Henn et al. | |
| 2002/0076250 | A1 | 6/2002 | Johnson et al. | |
| 2005/0206072 | A1 * | 9/2005 | Tanabe | 271/226 |
| 2009/0060608 | A1 * | 3/2009 | Shoji et al. | 399/394 |

FOREIGN PATENT DOCUMENTS

| | | |
|---|---|---|
| JP | 3-094275 | 4/1991 |
| JP | 5-124752 | 5/1993 |
| JP | 8-091676 | 4/1996 |
| JP | 9-183539 | 7/1997 |
| JP | 09-301577 | 11/1997 |
| JP | 10-203690 | 8/1998 |
| JP | 11-030884 | 2/1999 |
| JP | 2893540 | 3/1999 |
| JP | 11-189355 | 7/1999 |
| JP | 2000-086019 | 3/2000 |
| JP | 3332161 | 7/2002 |
| JP | 2002-265097 | 9/2002 |
| JP | 2002-308469 | 10/2002 |
| JP | 2003-206051 | 7/2003 |
| JP | 2003-252485 | 9/2003 |
| JP | 2005/022820 | 1/2005 |
| JP | 2005-059966 | 3/2005 |

OTHER PUBLICATIONS

Office Action dated Jan. 18, 2011, in corresponding Japanese Patent Application No. 2006-225253.

Japanese Office Action dated Jul. 11, 2011 issued in corresponding Japanese Application No. 2007-103364.

Japanese Office Action dated Apr. 22, 2011 issued in corresponding Japanese Application No. 2007-103364.

Extended Search Report dated Nov. 27. 2007.

* cited by examiner

SHEET ALIGNING DEVICE AND IMAGE FORMING APPARATUS INCLUDING THE SAME

BACKGROUND OF THE INVENTION

1. Field of the Invention

The present invention relates generally to sheet conveying mechanisms in electrophotographic image forming apparatuses, and more particularly to improving precision in correcting the sheet position in the main scanning direction and correcting a skewed condition of a sheet.

2. Description of the Related Art

In image forming apparatuses such as laser printers, sheets such as transfer sheets stacked on a sheet feeder are conveyed one by one. Then, a toner image formed on a photoconductive drum or a photoconductive belt is transferred onto each sheet at a transfer position. Finally, the toner image is fixed onto the sheet, thereby obtaining a recorded sheet.

In such an image forming apparatus, a registration mechanism including a stopper and a pair of rollers is provided just before the transfer position. The registration mechanism corrects the position of a sheet so that the toner image is transferred onto the correct position.

In this image forming apparatus, the stopper is provided on the sheet conveyance path, which stopper determines the position of a sheet in a direction perpendicular to the sheet conveying direction. The leading edge of a sheet abuts the stopper, and while the leading edge is being stopped, a conveying unit positioned on the upstream side conveys the sheet, so that the sheet forms a loop. Then, the stopper is released, so that the leading edge of the sheet is nipped and conveyed by the pair of rollers situated downstream of the stopper. A detecting unit is arranged near a downstream position of the stopper for detecting side portions of the sheet. A moving unit includes a pair of rollers that is movable in a direction orthogonal to the sheet conveying direction. The detecting unit and the moving unit function to correct the sheet position so that the sheet is positioned along a sheet scanning reference position (see, for example, Patent Document 1).

FIG. 7 is a schematic diagram of a conventional sheet conveying mechanism.

In FIG. 7, the reference numeral 32 denotes a pair of horizontal registration rollers, 33 denotes a stopper, 34 denotes a pair of feed rollers, 35 denotes a sheet edge detecting sensor, 36 denotes a pair of conveying rollers, 37 and 38 denote sheet conveyance paths, 39 denotes a sheet, 40 and 41 denote sheet trays, C denotes a buffer, and D denotes a sheet conveyance path junction.

The stopper 33 is arranged at a stage immediately before the pair of horizontal registration rollers 32. The stopper can be switched between a position for closing the sheet conveyance path and a position for opening the sheet conveyance path. The sheet conveyance path is configured in such a manner that the distance between the pair of horizontal registration rollers 32 and the pair of feed rollers 34 is wide enough for a small-sized sheet to be conveyed. Furthermore, there are two sheet conveyance paths at the stage before the pair of feed rollers 34; i.e., the conveyance path 38 extending from the sheet tray 40 provided in the main unit of an image forming apparatus (e.g., a printer) and the conveyance path 37 extending from the sheet tray 41 outside the image forming apparatus. Each of these conveyance paths 37 and 38 is provided with one of the pairs of conveying rollers 36 for sending the sheet 39 toward the pair of feed rollers 34. Furthermore, these two conveyance paths 37 and 38 merge at the junction D located on the upstream side of the pair of feed rollers 34.

Operations of correcting the sheet conveying position and correcting a skewed condition of the sheet 39 are described. The sheet 39 being conveyed by the pair of feed rollers 34 is stopped as the leading edge of the sheet 39 abuts the stopper 33, which stopper 33 is previously situated at a position for closing the sheet conveyance path. At this point, the leading edge of the sheet 39 abuts along the stopper 33, and therefore, a skewed condition of the sheet 39 is corrected. Then, the pair of feed rollers 34 conveys the sheet 39 for a certain amount of time, so that the buffer C is formed between the stopper 33 and the pair of feed rollers 34. Subsequently, the stopper 33 is lowered, thus releasing the leading edge of the sheet 39 from the stopped status. Consequently, due to the rigidity of the buffer C formed in the sheet 39, the leading edge of the sheet 39 is forced to stick out and wedge into the nip portion of the pair of horizontal registration rollers 32. At this point, the sheet 39 is released from the nip of the pair of feed rollers 34, a position of the edge (side edge) of the sheet 39 in the sheet main scanning direction is detected by the sheet edge detecting sensor 35, and the correction amount in the sheet main scanning direction is calculated. Then, the pair of horizontal registration rollers 32 is caused to horizontally move in the roller axial direction in accordance with the calculated correction amount. Accordingly, by performing the operation of correcting the sheet position in the main scanning direction (horizontal registration) with the pair of horizontal registration rollers 32, it is possible to align the position of the sheet 39 with the main scanning direction without affecting the pair of feed rollers 34.

In this sheet conveying mechanism, to correct the sheet conveying position and to correct a skewed condition of a sheet that is longer than the distance between the pair of horizontal registration rollers 32 and the pair of conveying rollers 36, the following situation may occur. That is, the trailing edge of the sheet 39 may still be sandwiched (held with pressure) by the pair of conveying rollers 36 when the leading edge of the sheet 39 has wedged into the nip portion of the pair of horizontal registration rollers 32. In such a condition, if the pair of horizontal registration rollers 32 is horizontally moved to correct the sheet position in the main scanning direction, the nip portion of the pair of conveying rollers 36 will act as a resistance. As a result, the sheet 39 may become twisted and wrinkled, or the skew of the sheet 39 that has been corrected at the stopper 33 may reappear. For these reasons, in this case, the nip portion of the pair of conveying rollers 36 is opened.

Incidentally, when the leading edge of the sheet 39 is released from the stopped status by lowering the stopper 33 after the buffer C has been formed between the stopper 33 and the pair of feed rollers 34, the following situation may occur if the sheet 39 is curled or if the sheet 39 has low rigidity. That is, the sheet 39 may become buckled or skewed before being nipped by the pair of horizontal registration rollers 32, so that the position of the sheet 39 is shifted or a paper jam occurs. Meanwhile, if the sheet 39 is highly rigid, the skew of the sheet 39 corrected at the stopper 33 may reappear before the sheet 39 wedges into the nip portion of the pair of horizontal registration rollers 32. If this happens, it would be meaningless to correct the skew at the stopper 33. To solve these problems, there is a configuration in which the stopper 33 is arranged on the downstream side of the pair of horizontal registration rollers 32 (see, for example, Patent Document 2).

In the above configuration, both the stopper and the conveying unit need to be provided with a driving unit, which leads to an increase in the size of the apparatus as well as higher manufacturing costs.

Even if the above problems are solved, when conveying a thick sheet that has body and that is longer than the distance between the pair of horizontal registration rollers 32 and the sheet conveyance path junction D, a problem arises if the curvature radius of each of the sheet conveyance paths between the corresponding sheet tray and the pair of feed rollers 34 is too small. Specifically, the trailing edge of the sheet remaining in the sheet conveyance path receives a large conveyance resistance that is caused by the small curvature radius of the sheet conveyance path. As a result, the resistance caused by the small curvature radius of the sheet conveyance path obstructs the movement of conveying the sheet 39 in the main scanning direction when correcting the position of the sheet 39 in the main scanning direction with the pair of horizontal registration rollers 32. This decreases the precision of conveying and aligning the sheet.

Patent Document 1: Japanese Patent No. 2893540

Patent Document 2: Japanese Laid-Open Patent Application No. H10-203690

SUMMARY OF THE INVENTION

The present invention provides a sheet aligning device and an image forming apparatus in which one or more of the above-described disadvantages are eliminated.

A preferred embodiment of the present invention provides a sheet aligning device and an image forming apparatus in which a sheet conveyed in a skewed condition is precisely corrected before being sent to a transfer position under various conditions.

Furthermore, a preferred embodiment of the present invention provides a sheet conveying mechanism including plural sheet conveyance paths extending in different manners and a junction of the sheet conveyance paths. The sheet conveyance paths are provided on an upstream side of a sheet aligning mechanism unit. When the trailing edge of a sheet is remaining on the upstream side of the junction in the sheet conveyance path while correcting the horizontal sheet conveyance position and correcting the skewed condition of the sheet, the resistance applied to the trailing edge of the sheet is reduced. Therefore, the horizontal sheet conveyance position and the skewed condition of the sheet can be precisely corrected.

An embodiment of the present invention provides a sheet aligning device including a sheet conveyance path; a detecting unit configured to detect a side edge of a sheet being conveyed in the sheet conveyance path; a stopper provided on an upstream side of the detecting unit and configured to open/close in such a manner as to allow/prevent passage of the sheet through the sheet conveyance path and to position a leading edge of the sheet being conveyed in the sheet conveyance path; a first conveying unit provided on an upstream side of the stopper, the first conveying unit including a pair of first rollers configured to come in contact with/separate from each other; a second conveying unit provided on an upstream side of the first conveying unit, the second conveying unit including a pair of second rollers configured to come in contact with/separate from each other; and a horizontal movement unit configured to move the pair of first rollers in an axial direction of the first rollers based on a detection result output by the detecting unit.

An embodiment of the present invention provides an image forming apparatus including a sheet conveyance path; at least one pair of conveying rollers; a pair of feed rollers; a pair of horizontal registration rollers; a stopper configured to correct a skewed condition of a sheet being conveyed in the sheet conveyance path and to open/close in such a manner as to allow/prevent passage of the sheet through the sheet conveyance path; and a detecting unit configured to detect a position of a side edge of the sheet, wherein the pair of conveying rollers, the pair of feed rollers, the pair of horizontal registration rollers, the stopper, and the detecting unit are provided along the sheet conveyance path in the stated order starting from an upstream side of a sheet conveyance direction; and the rollers of each of the pair of conveying rollers, the pair of feed rollers, and the pair of horizontal registration rollers are configured to come in contact with/separate from each other, the image forming apparatus further including a control unit configured to perform horizontal registration correction while the pair of horizontal registration rollers is conveying the sheet after the skewed condition has been corrected by the stopper, the horizontal registration correction being performed based on a detection result output by the detecting unit, the control unit also being configured to control the pair of conveying rollers and the pair of feed rollers, which are provided on an upstream side of the pair of horizontal registration rollers, not to sandwich the sheet at least during the horizontal registration correction.

According to one embodiment of the present invention, a sheet aligning device and an image forming apparatus are provided, which include a mechanism for precisely positioning the leading edge of the sheet before the sheet is sent to a transfer position. Paper jams are prevented and the leading edge of the sheet is prevented from bending in a registration unit of the mechanism. The mechanism can be manufactured at low cost.

According to one embodiment of the present invention, a pair of sheet conveying rollers is positioned on the upstream side of a junction of sheet conveyance paths, and the sheet conveying rollers can be separated from each other. On the upstream side of the junction of sheet conveyance paths, the sheet conveyance paths extend in a straight manner or in a curved manner with a curvature radius of 50 mm or more. Accordingly, regardless of the length or thickness of the sheet, it is possible to reduce the resistance applied to the sheet while aligning the sheet conveyance position with the main scanning direction in the sheet aligning mechanism. Consequently, the sheet aligning mechanism can align the sheet conveyance position with high precision.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
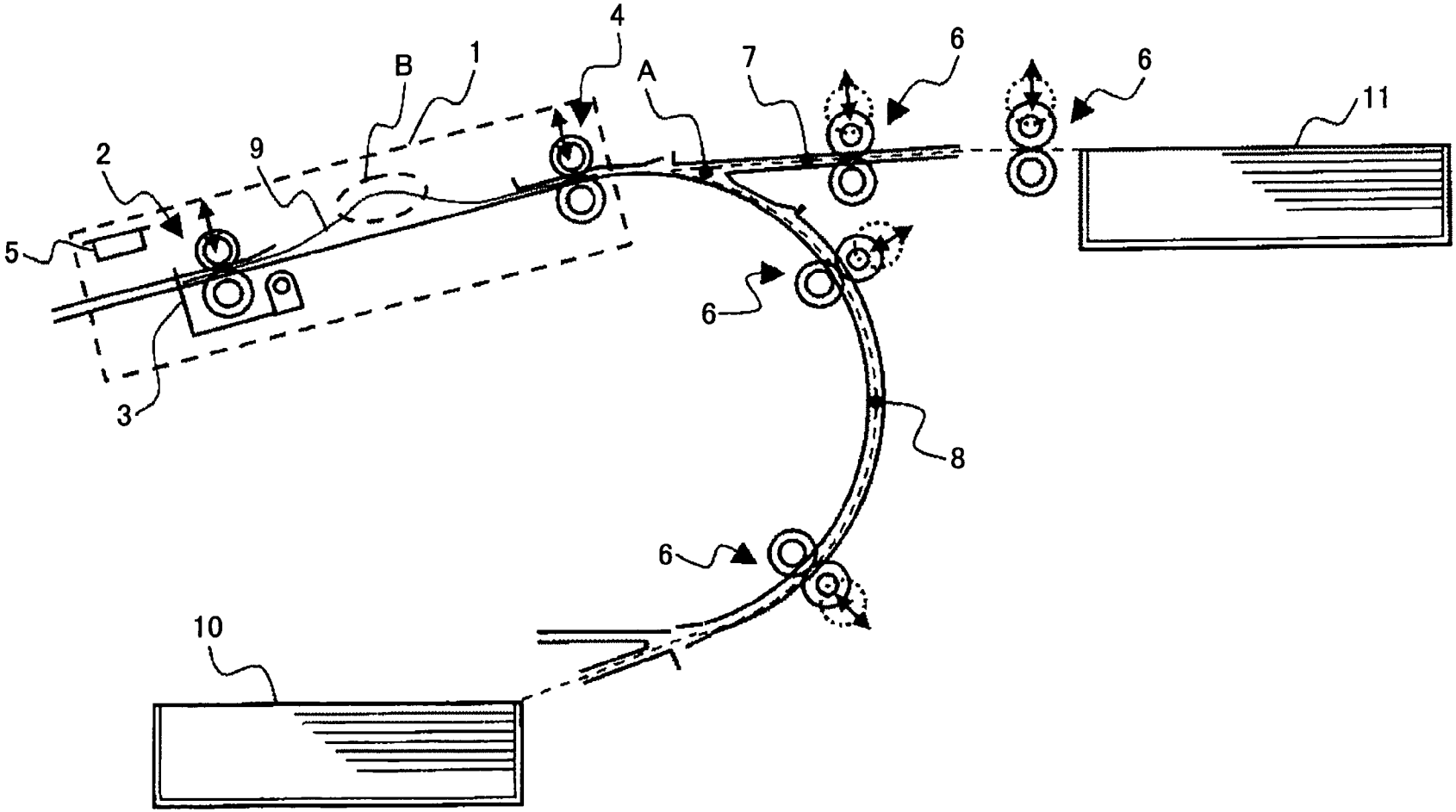
FIG. 1 illustrates an example of a sheet conveying mechanism according to an embodiment of the present invention.

FIG. 1 illustrates an example of a sheet conveying mechanism according to an embodiment of the present invention.

In FIG. 1, the reference numeral 1 denotes a sheet aligning mechanism, 2 denotes at least one pair of horizontal registration rollers acting as the first pair of rollers, 3 denotes a stopper with a claw portion on one end, 4 denotes at least one pair of feed rollers acting as the second pair of rollers, 5 denotes a detecting sensor, 6 denotes pairs of conveying rollers acting as the third pairs of rollers, 7 denotes a straight sheet conveyance path, 8 denotes a curved sheet conveyance path, 9 denotes a sheet, 10 and 11 denote sheet trays, A denotes a sheet conveyance path junction, and B denotes a buffer.

There are two sheet conveyance paths at the stage before the pair of feed rollers 4; i.e., the curved sheet conveyance path 8 extending from the sheet tray 10 provided in the main unit of an image forming apparatus and the straight sheet conveyance path 7 extending from the sheet tray 11 outside the image forming apparatus. Each of these conveyance paths 7 and 8 is provided with the pairs of conveying rollers 6 for sending the sheet 9 toward the pair of feed rollers 4. The distance between adjacent pairs of conveying rollers 6 is 150 mm through 180 mm, so that a small-sized sheet can be conveyed. In each of the pairs of rollers, one roller acts as a driving roller and the other roller acts as a following roller, and the driving roller and the following roller can be separated from each other. Furthermore, the straight sheet conveyance path 7 and the curved sheet conveyance path 8 merge at the junction A located upstream of the pair of feed rollers 4.

The sheet aligning mechanism 1 includes the pair of horizontal registration rollers 2, the stopper 3, the pair of feed rollers 4, and the detecting sensor 5 including a CIS sensor, a CCD linear image sensor, etc., for detecting the side edge of the sheet 9. The conveyance path between the pair of horizontal registration rollers 2 and the pair of feed rollers 4 has a distance of 100 mm through 180 mm and has a substantially straight shape so that a small-sized sheet can be conveyed therethrough. Unlike conventional stoppers, the stopper 3 is arranged immediately downstream of the pair of horizontal registration rollers 2. The stopper 3 can be switched between a position for closing the sheet conveyance path and a position for opening the sheet conveyance path.

Operations of correcting the sheet conveying position and correcting a skewed condition of the sheet 9 in the sheet aligning mechanism 1 are described. Before the leading edge of the sheet 9 reaches the pair of horizontal registration rollers 2, the rollers of the pair of horizontal registration rollers 2 are separated from each other, and the stopper 3 is raised in such a manner that its claw portion closes the sheet conveyance path. The conveyance speed is reduced immediately before the leading edge of the sheet 9 abuts the claw portion of the stopper 3. Then, the sheet 9 is pushed into the stopper 3 while being sandwiched by the pair of feed rollers 4. After the buffer B is formed in the sheet 9 between the stopper 3 and the pair of feed rollers 4, the leading edge of the sheet 9 is caused to abut along the claw portion of the stopper 3. Accordingly, a skewed condition of the sheet 9 is corrected. Then, the sheet 9 is sandwiched by the pair of horizontal registration rollers 2. The following describes an example where a CCD linear image sensor is employed as the detecting sensor 5.

Subsequently, the stopper 3 is lowered to release the leading edge of the sheet 9 and the rollers of the pair of feed rollers 4 are separated from each other. The sheet 9 is conveyed by the pair of horizontal registration rollers 2. When the sheet 9 reaches the detecting sensor 5, the detecting sensor 5 detects the edge position of the sheet 9 in the main scanning direction. A not shown control unit calculates the correction amount of the sheet 9 in the main scanning direction. Further, the control unit causes the pair of horizontal registration rollers 2 to horizontally move in the roller axial direction in accordance with the calculated correction amount. Accordingly, the position of the sheet 9 is aligned with the main scanning direction and the operation of correcting the sheet position is completed. Even during the horizontal movement, the horizontal registration rollers 2 rotate in order to keep conveying the sheet 9. Thus, it is possible to minimize wasted time.

Subsequently, when the sheet 9 is sandwiched by a sheet conveying device (e.g., a transfer unit) including not shown rollers arranged on the downstream side of the pair of horizontal registration rollers 2, the rollers of the pair of horizontal registration rollers 2 are separated from each other once again, to be returned to a home position (described below).

When performing the sheet aligning operation for a conveyed sheet that is longer than the distance between the stopper 3 and the pair of conveying rollers 6 closest to the sheet conveyance path junction A, the control unit controls at least the pair(s) conveying rollers 6 over which the sheet extends in such a manner that the conveying rollers 6 are separated from each other.

In the sheet aligning operation performed by the sheet conveying mechanism formed as described above, at the stage of horizontally moving the pair of horizontal registration rollers 2 in the roller axial direction, the sheet 9 is only held by the pair of horizontal registration rollers 2 regardless of the length of the sheet. Therefore, the only resistance applied to the sheet 9 on the upstream side of the pair of horizontal registration rollers 2 is the friction between the sheet 9 and the sheet conveyance path. As described above, the sheet conveyance path of the sheet aligning mechanism 1 is straight, and therefore, it is possible to minimize the conveyance resistance applied to the sheet 9 while the sheet conveying position is being aligned by the pair of horizontal registration rollers 2. As a result, while the pair of horizontal registration rollers 2 moves horizontally, the force with which the sheet 9 is held by the pair of horizontal registration rollers 2 significantly exceeds the resistance applied to the sheet 9 on the upstream side of the pair of horizontal registration rollers 2. Hence, after the skewed condition of the sheet 9 is corrected at the stopper 3, the sheet 9 is prevented from becoming twisted and wrinkled due to a resistance applied to the sheet 9 on the upstream side of the pair of horizontal registration rollers 2. Thus, operations of conveying and aligning the sheet 9 can be performed with high precision in the sheet aligning mechanism 1.

Figure 2A:
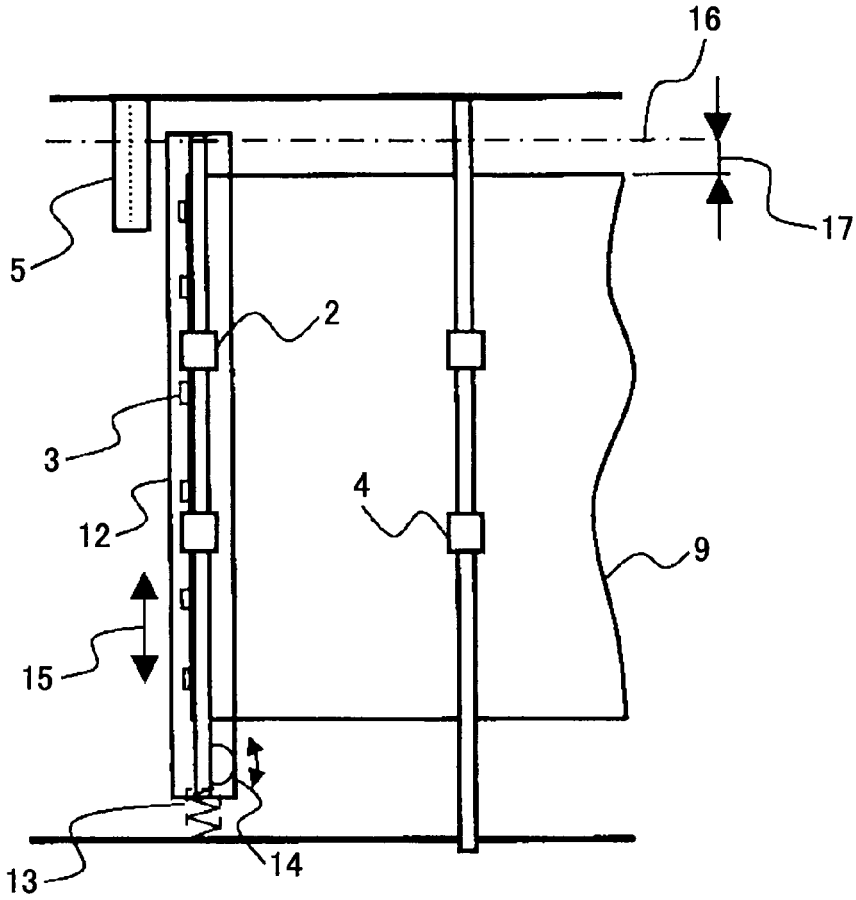
FIGS. 2A through 2C are top views of a sheet aligning device according to an embodiment of the present invention.
Figure 2B:
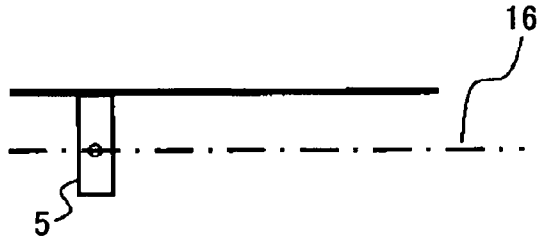
Figure 2C:
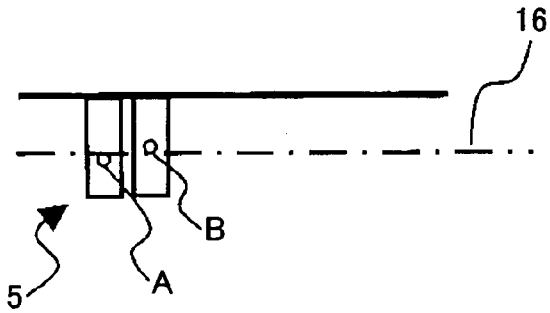

FIGS. 2A through 2C are top views of a sheet aligning device according to an embodiment of the present invention. FIG. 2A is a partial schematic diagram of an example employing a linear sensor, FIG. 2B is a partial view of an example employing one photo-coupler, and FIG. 2C is a partial view of an example employing two photo-couplers.

In FIGS. 2A through 2C, the reference numeral 12 denotes a unit frame, 13 denotes a spring, 14 denotes a cam, 15 denotes an arrow indicating the direction in which the sheet 9 is moved, 16 denotes a sheet conveyance reference position, and 17 denotes the shift amount of the position of the sheet side edge.

The detecting sensor 5 for detecting the sheet side edge position is arranged downstream of the stopper 3. The pair of horizontal registration rollers 2 is joined to the unit frame 12, and is configured to be moved in its axial direction by a horizontal movement unit. The horizontal movement unit includes the unit frame 12, the spring 13, the cam 14 having a rotational axis provided in the main unit of the image forming apparatus, and a not shown driving source that rotationally drives the cam 14.

The unit frame 12 is constantly pressed against the cam 14 by the spring 13. By the rotation of the cam 14, the unit frame 12 can be moved in a direction (the direction indicated by the arrow 15) perpendicular to the sheet conveyance direction, that is, the axial direction of the pair of horizontal registration rollers 2.

When the detecting sensor 5 detects that the sheet side edge is shifted from the sheet conveyance reference position 16, the cam 14 rotates to correct the position of the sheet 9 by an amount corresponding to the shift amount 17 so that the sheet side edge is aligned with the predetermined sheet conveyance reference position 16.

By employing a linear image sensor including a CCD array as the detecting sensor 5 as shown in FIG. 2A, the shift amount of the sheet side edge from the reference position can be easily measured with the conventional technology. This shift amount is converted into the rotation amount of the cam 14 so that the cam 14 rotates by an amount corresponding to the correction amount. The measured value is output as a discrete value with respect to the length; however, no problems should arise as long as the length corresponding to one bit of the pixel of the CCD array (distance in the shift direction of the side edge) is less than or equal to the allowable error of sheet alignment.

As shown in FIG. 2B, when a simple photo-coupler for detecting one point is employed as the detecting sensor 5, the horizontal shift amount of the sheet 9 cannot be directly calculated. However, the direction in which the sheet 9 is shifted can be detected. Therefore, the horizontal position of the sheet 9 can be controlled by directly feeding back the output of the photo-coupler to the control unit that controls the cam 14.

This control method is described below. In a first case where light flux is blocked by the sheet 9 such that an output cannot be obtained, the sheet 9 is horizontally moved in a direction toward a position where an output can be obtained (direction toward the sheet center). As soon as an output is obtained, the sheet 9 is stopped. Meanwhile, in a second case where light flux is not blocked by the sheet 9, the sheet 9 is horizontally moved in a direction opposite to that of the first case until an output cannot be obtained. The horizontal movement can be stopped as soon as the output is turned off; however, the stopping position would not be the same as that of the first case. Accordingly, a large error may often be caused between the stopping position of the first case and the stopping position of the second case. Thus, when the output is turned off, the sheet 9 is once again horizontally moved in a direction toward a position where an output can be obtained. As soon as an output is obtained, the horizontal movement is stopped. By this method, a stopping error may only be caused by the stopping error of the motor rotating the cam 14 and the error in the time taken by a stop command to reach the cam 14. One option is to stop the movement as soon as the output is obtained in both the first and second cases and another option is to stop the movement as soon as the output is turned off in both the first and second cases. Either option can be chosen according to the design of the sheet aligning device.

The cam 14 is controlled by the control unit to stay at a home position where minimal horizontal movement is caused under regular conditions, i.e., when the sheet 9 is conveyed along the sheet conveyance reference position 16. Thus, after rotating the cam 14 so that the pair of horizontal registration rollers 2 is horizontally moved, and when the correction has been made, the control unit causes the cam 14 to return to its original position, i.e., the home position.

There is a method of employing two photo-couplers as the detecting sensor 5. The detection positions of the two photo-couplers (supposedly photo-couplers A and B) are arranged to be opposite to each other across the sheet conveyance reference position 16. The distance between the two detection positions approximately corresponds to the allowable error of horizontal registration.

For example, the photo-coupler A is arranged on the side closer to the sheet center with respect to the sheet conveyance reference position 16. If an output cannot be obtained from the photo-coupler A as light flux is blocked by the sheet 9 but an output can be obtained from the photo-coupler B, the side edge of the sheet 9 is at a desirable position. When outputs are obtained from both photo-couplers A and B, or when outputs of both photo-couplers A and B are turned off, the side edge of the sheet 9 is horizontally shifted. Accordingly, the shift can be corrected by moving the sheet 9 in corresponding directions, until the output of the photo-coupler A is turned off in the former case, and until the output of the photo-coupler B is obtained in the latter case.

Figure 3:
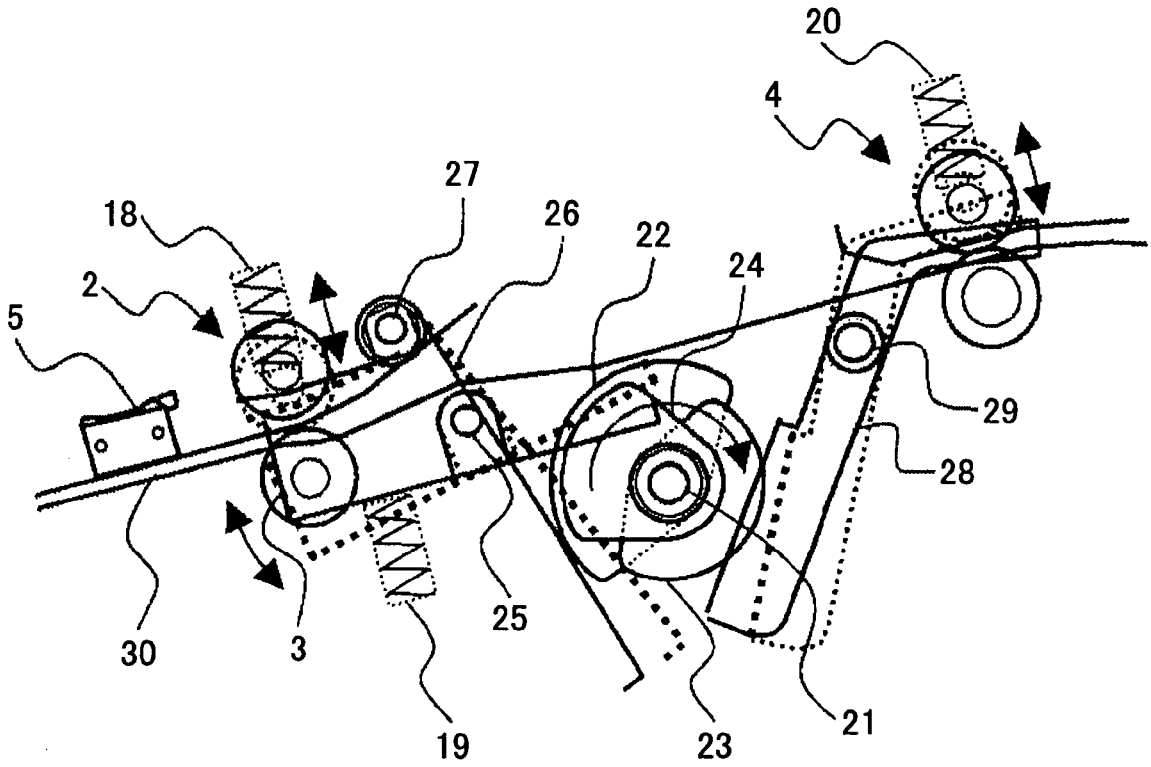
FIG. 3 is a side view of the sheet aligning device according to an embodiment of the present invention.

FIG. 3 is a side view of the sheet aligning device according to an embodiment of the present invention.

In FIG. 3, the reference numerals 18, 19, and 20 denote springs, 21 denotes a camshaft, 22, 23, and 24 denote cams, 25 denotes a spindle of the stopper 3, 26 denotes a retract arm for moving together/apart the horizontal registration rollers 2, 27 denotes a spindle of the retract arm 26, 28 denotes a retract arm for moving together/apart the feed rollers 4, 29 denotes a spindle of the retract arm 28, and 30 denotes a sheet conveyance path.

The stopper 3 is rotatable about the spindle 25, and is caused to protrude into the sheet conveyance path 30 by the spring 19. The stopper 3 is configured to open the sheet conveyance path 30 by being moved by the cam 23.

The primary parts of the sheet aligning device are first and second conveying units. The first conveying unit includes the pair of horizontal registration rollers 2, a driving mechanism, and a contact/separation mechanism thereof. The second conveying unit includes the pair of feed rollers 4, a driving mechanism, and a contact/separation mechanism thereof.

The pair of horizontal registration rollers 2 is arranged upstream of the stopper 3, and the rollers of the pair of horizontal registration rollers 2 are pressed against each other by the spring 18. The rollers of the pair of horizontal registration rollers 2 can be separated from each other as the retract arm 26 (hereinafter, simply referred to as "arm 26") rotatable about the spindle 27 is pushed up by the cam 22. Similarly, the rollers of the pair of feed rollers 4 are also pushed against each other by the spring 20. The rollers of the pair of feed rollers 4 can be separated from each other as the retract arm 28 (hereinafter, simply referred to as "arm 28") rotatable about the spindle 29 is pushed up by the cam 24. The cam 22, the cam 23, and the cam 24 are fixed along the same shaft, i.e., the camshaft 21. As the camshaft 21 rotates by a predetermined angle, the cam 22, the cam 23, and the cam 24 perform the following operations in combination, i.e., contact/separation of the pair of horizontal registration rollers 2, opening/closing of the sheet conveying path 30 by the stopper 3, and contact/separation of the pair of feed rollers 4.

Figure 4A:
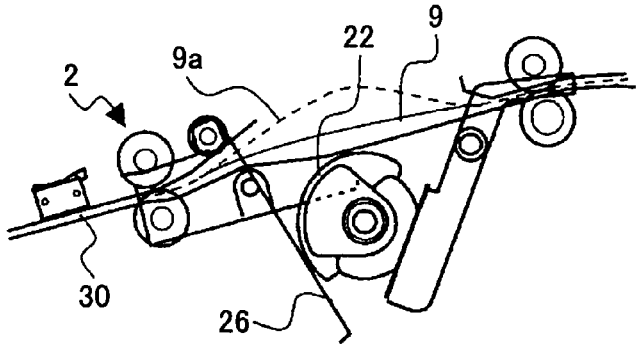
FIGS. 4A through 4E are schematic diagrams illustrating operations according to an embodiment of the present invention.
Figure 4B:
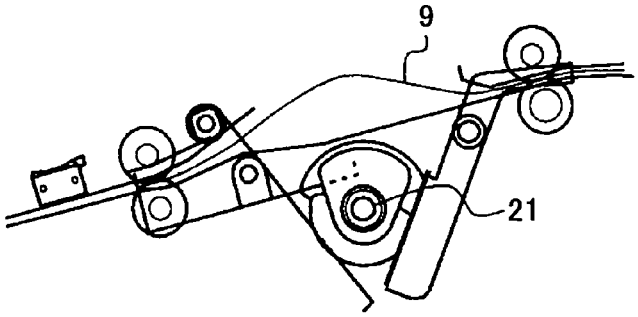
Figure 4C:
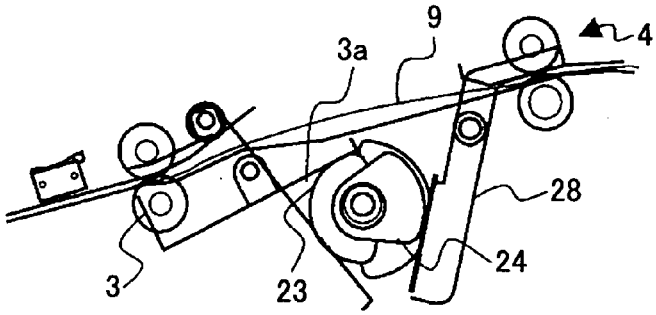
Figure 4D:
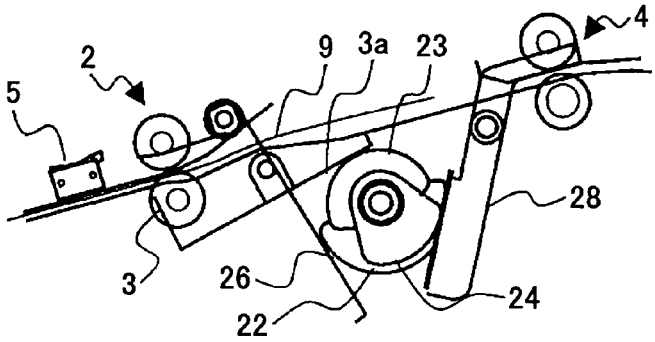
Figure 4E:
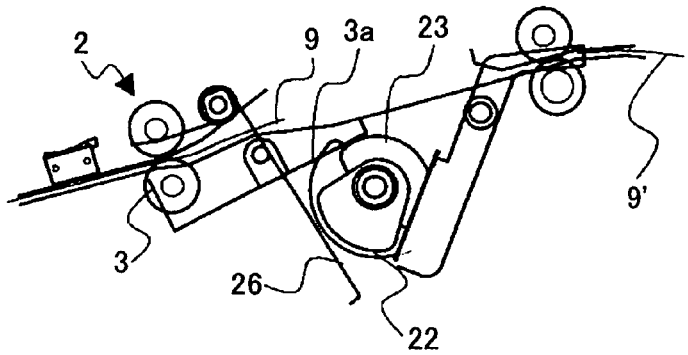

FIGS. 4A through 4E are schematic diagrams illustrating operations according to an embodiment of the present invention. FIG. 4A illustrates a status where the horizontal registration rollers 2 are open (separated). FIG. 4B illustrates a status where none of the cams are operating. FIG. 4C illustrates a status where the stopper 3 and the feed rollers 4 are open. FIG. 4D illustrates a status where the stopper 3, the feed rollers 4, and the horizontal registration rollers 2 are open. FIG. 4E illustrates a status where the horizontal registration rollers 2 are open.

In each of the FIGS. 4A through 4E, the elements denoted by a reference numeral are relevant to the illustrated operation.

Figure 5:
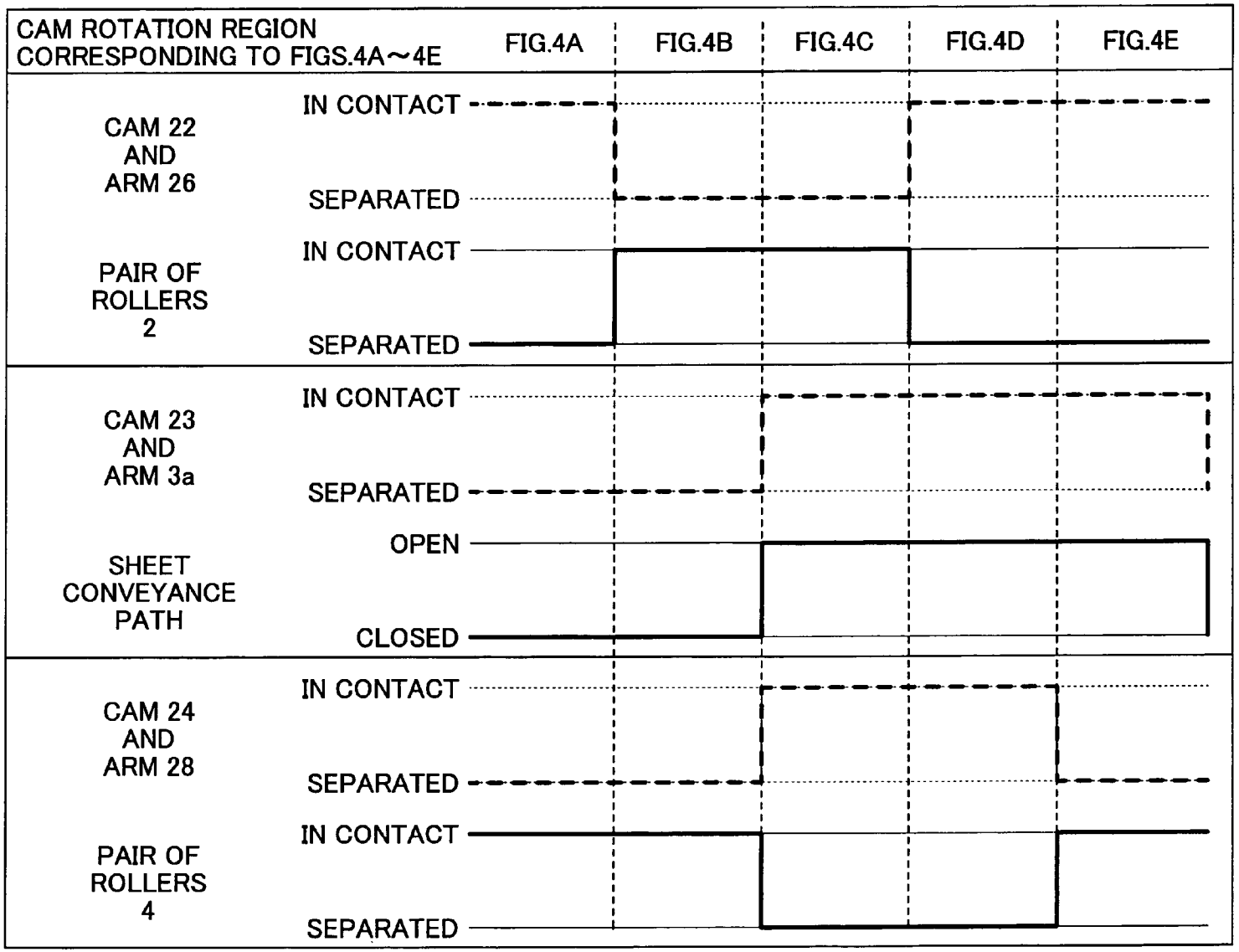
FIG. 5 is a timing chart of the operations of the mechanism illustrated in FIGS. 4A through 4E.

FIG. 5 is a timing chart of the operation of the mechanism illustrated in FIGS. 4A through 4E.

In FIG. 5, the thick dashed line indicates the status of a cam and its corresponding member. "IN CONTACT" indicates that the corresponding elements are in contact (or operating) and "SEPARATED" indicates the corresponding elements are separated (or opened). "OPEN" indicates that the sheet conveying path 30 is open and "CLOSED" indicates that the sheet conveying path 30 is closed. The regions corresponding to FIGS. 4A through 4E have equal sizes in the horizontal direction as a matter of convenience. However, these sizes do not represent the actual region of the rotational angle of the camshaft 21 corresponding to the respective statuses.

The operation of the mechanism illustrated in FIGS. 4A through 4E is described with reference to FIG. 5.

In FIG. 4A, the stopper 3 is protruding into the sheet conveyance path 30. The horizontal registration rollers 2 are separated from each other as the cam 22 is in contact with the arm 26 to press up one of the rollers against the force of the spring 18. The feed rollers 4 are pressed against each other and are sandwiching the sheet 9. Due to the rotation of the pair of feed rollers 4, the sheet 9 is conveyed at a prescribed speed. When the leading edge of the sheet 9 reaches a position immediately before the stopper 3, the conveyance speed is reduced, and then the leading edge of the sheet 9 abuts the stopper 3. Further, the sheet 9 is pushed in the sheet conveyance direction by the pair of feed rollers 4. When a loop 9*a* is formed in the sheet 9, the pair of feed rollers 4 stops rotating. At this point, due to the force of the loop 9*a*, the leading edge of the sheet 9*a* collides with the stopper 3, so that the skewed condition of the sheet 9 is corrected.

In FIG. 5, in the region corresponding to FIG. 4A, the cam 22 and the arm 26 are "IN CONTACT", and therefore, the horizontal registration rollers 2 are "SEPARATED". The cam 23 and an arm 3*a* are "SEPARATED", and therefore, the sheet conveyance path 30 is "CLOSED". The cam 24 and the arm 28 are "SEPARATED", and therefore, the feed rollers 4 are as "IN CONTACT".

In FIG. 4B, as the camshaft 21 rotates, the cam 22 comes off the arm 26, and the horizontal registration rollers 2 are pressed against each other by the force of the spring 18. At this point, the sheet 9 is sandwiched by the pair of horizontal registration rollers 2, after its skewed condition is corrected at the stopper 3. At this point, the cam 23 and the cam 24 are not yet in contact with their respective arms.

In FIG. 5, in the region corresponding to FIG. 4B, all of the cams are in a "SEPARATED" status, and their corresponding rollers or arms are in a stable status due to forces of springs. Specifically, the horizontal registration rollers 2 are "IN CONTACT", the feed rollers 4 are "IN CONTACT", and the sheet conveyance path 30 is "CLOSED" by the claw portion of the stopper 3.

In FIG. 4C, as the camshaft 21 rotates further, the cam 23 contacts the arm 3*a* on the side opposite to the claw portion, across the spindle 25 of the stopper 3. As a result, the stopper 3 is rotated in a counter-clockwise direction against the force of the spring 19, so that the claw portion of the stopper 3 retreats and the sheet conveyance path 30 is opened. Furthermore, the cam 24 contacts the arm 28 so that the arm 28 is rotated in a counter-clockwise direction against the force of the spring 20 and the feed rollers 4 are separated. In this situation, the pair of horizontal registration rollers 2 conveys the sheet 9. The not shown photosensor (detecting sensor) 5 detects the sheet side edge position. The shift amount 17 from the sheet conveyance reference position 16 shown in FIG. 2A and the detected sheet side edge position is converted into the rotation amount of the cam 14. The cam 14 causes the pair of horizontal registration rollers 2 to move in the direction indicated by the arrow 15 while sandwiching and conveying the sheet 9 so that the sheet edge comes to the sheet conveyance reference position 16.

In FIG. 5, in the region corresponding to FIG. 4C, the mechanism is operating such that only the horizontal registration rollers 2 are "IN CONTACT". The pair of feed rollers 4 and the sheet conveyance path 30 are both "OPEN".

In FIG. 4D, when the sheet 9 has reached a not shown sheet conveying unit positioned on the downstream side or an image transfer position, the camshaft 21 rotates so that the cam 22 causes the horizontal registration rollers 2 to be separated. Subsequently, the cam 14 shown in FIG. 2A rotates further or rotates in a reverse direction so that the horizontal registration rollers 2 move in a direction opposite to the direction in which they moved in the status shown in FIG. 4C and return to the home position. At this point, the horizontal registration rollers 2 are still separated, and therefore, even if the middle of the sheet 9 is situated directly beneath the horizontal registration rollers 2, the behavior of the sheet 9 is unaffected.

In FIG. 5, in the region corresponding to FIG. 4D, all of the elements of the mechanism are open. That is, the horizontal registration rollers 2 and the feed rollers 4 are "SEPARATED", and the sheet conveyance path 30 is "OPEN". Under these conditions, the trailing edge of the sheet 9 passes through the feed rollers 4.

In FIG. 4E, before a next sheet 9' reaches the pair of feed rollers 4, the camshaft 21 rotates so that the cam 24 causes the feed rollers 4 to be pressed against each other, in order to be prepared to convey the next sheet 9'. Furthermore, after the trailing edge of the sheet 9 has passed the claw portion of the stopper 3 and before the leading edge of the next sheet 9' reaches the stopper 3, the cam 23 rotates to no longer be in contact with the arm 3*a*. Thus, the claw portion of the stopper 3 protrudes into the sheet conveyance path 30, returning to the status illustrated in FIG. 4A. Accordingly, the position of the next sheet 9' can be similarly corrected.

In FIG. 5, in the region corresponding to FIG. 4E, in a status where the sheet conveyance path 30 is "OPEN" and the horizontal registration rollers 2 are "IN CONTACT", the sheet 9 is conveyed and passed on to a conveying mechanism on a downstream side. The sheet 9 has already passed through the sheet aligning device, and therefore, the feed rollers 4 come "IN CONTACT" to be prepared to convey the next sheet.

Figure 6:
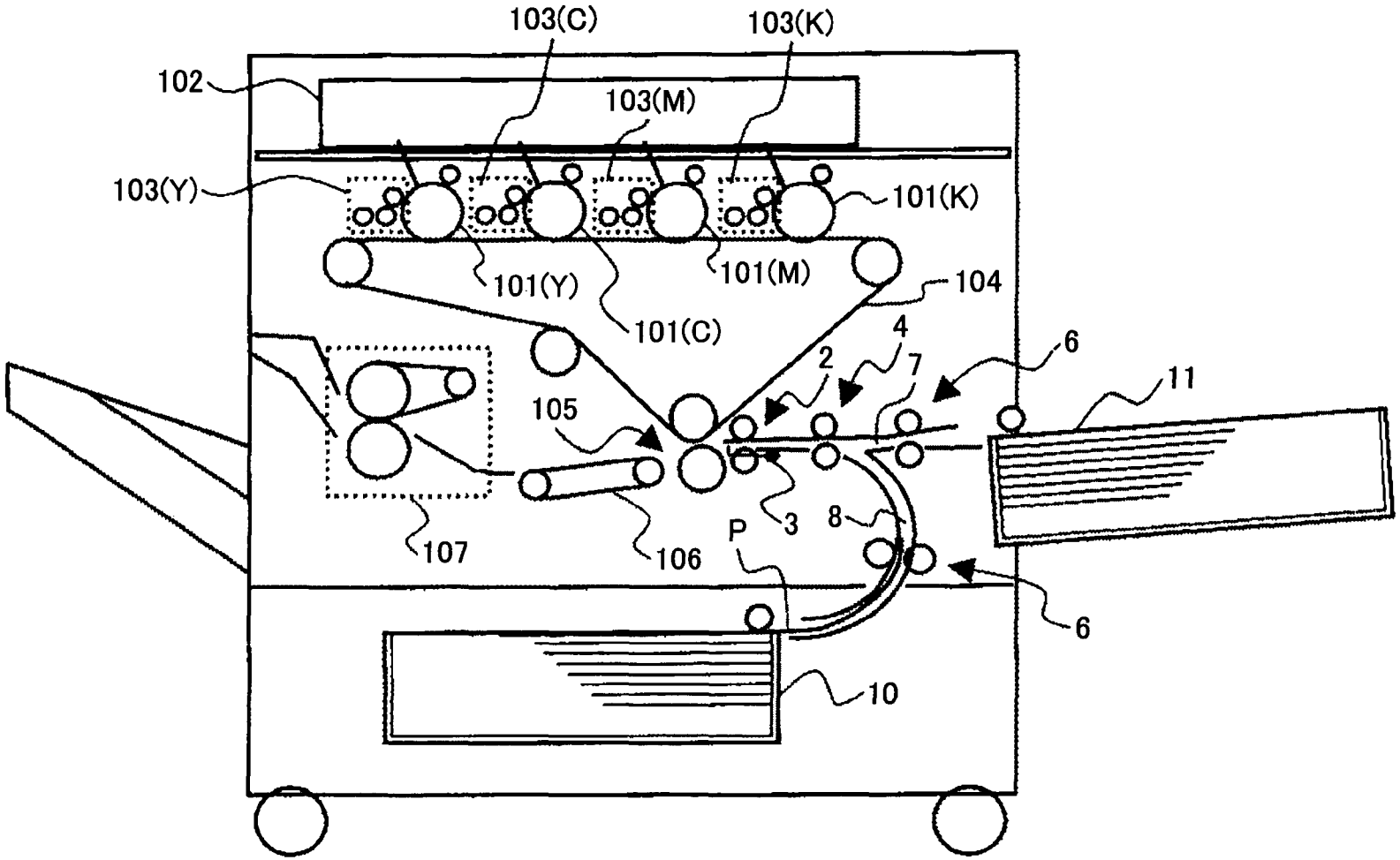
FIG. 6 illustrates an example of an image forming apparatus to which an embodiment of the present invention is applied.
Figure 7:
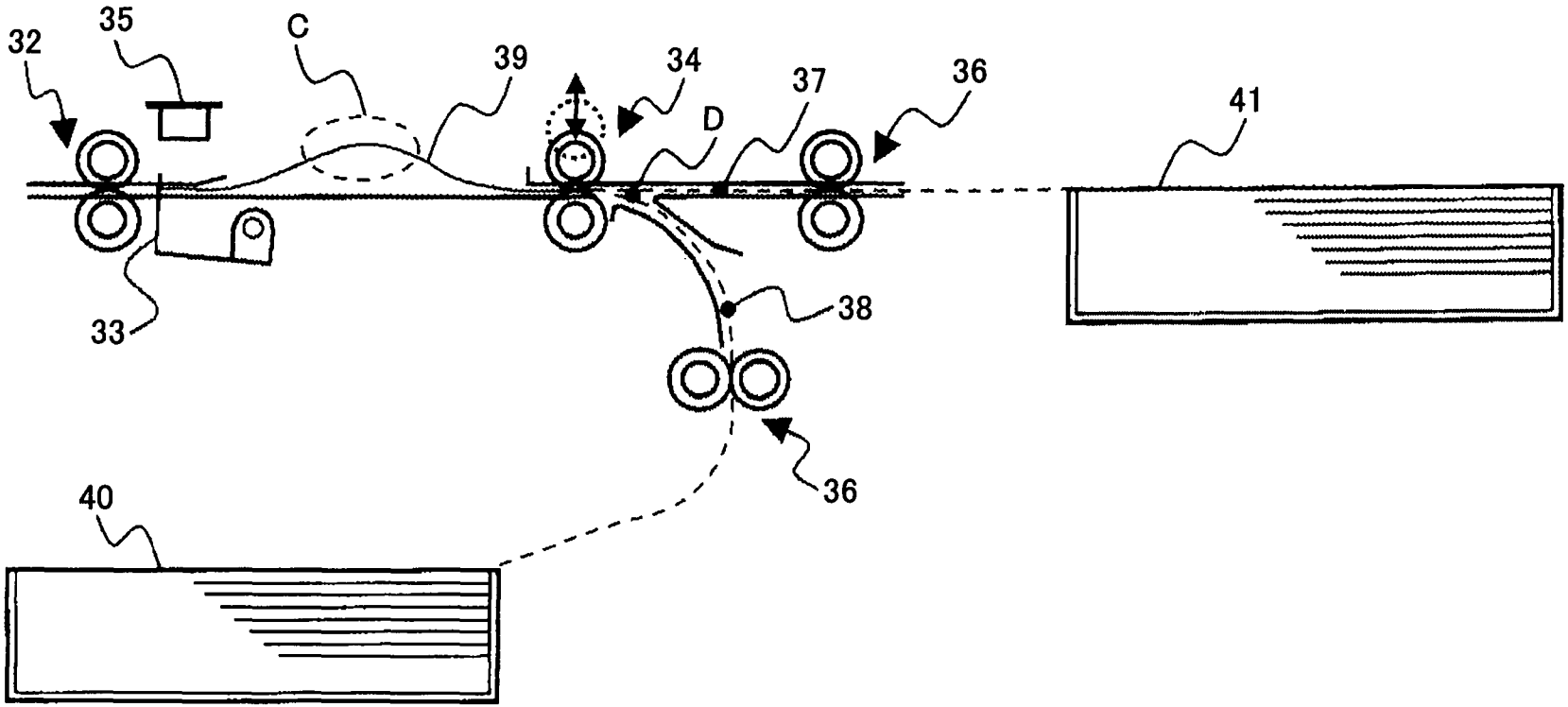
FIG. 7 is a schematic diagram of a conventional sheet conveying mechanism.

FIG. 6 illustrates an example of an image forming apparatus to which an embodiment of the present invention is applied.

In FIG. 6, the reference numeral 101 denotes photoconductors acting as image carriers, 102 denotes an optical writing device, 103 denotes developing devices, 104 denotes a transfer belt, 106 denotes a conveying device, 107 denotes a fixing device, and Y, C, M, and K respectively denote yellow, cyan, magenta, and black, which are development colors.

The optical writing device 102 forms latent images on the photoconductors 101, the developing devices 103 turn the latent images into visible images, and the images are then transferred onto the transfer belt 104.

A sheet P supplied from the sheet tray 10 is conveyed by the pair of conveying rollers 6 provided on the curved sheet conveyance path 8 to the pair of feed rollers 4. The pair of feed rollers 4 conveys the sheet P so that the leading edge of the sheet P abuts the claw portion of the stopper 3 inserted into the sheet conveyance path. When a sheet P is supplied from the sheet tray 11, the pair of conveying rollers 6 provided on the straight sheet conveyance path 7 conveys the sheet P to the pair of feed rollers 4, and similar operations follow.

At this point, the horizontal registration rollers 2 are open. After a skewed condition of the sheet P is corrected as the leading edge of the sheet P abuts the stopper 3, the horizontal registration rollers 2 sandwich the sheet P. Then, the stopper 3 retreats from the sheet conveyance path and the feed rollers 4 separate from each other. While conveying the sheet P, the horizontal registration rollers 2 move horizontally in accordance with output from a not shown detecting sensor to perform horizontal registration correction. The speed of horizontal movement is determined so that the correction is completed by the time the leading edge of the sheet P reaches a secondary transfer device 105. When the leading edge of the sheet P is nipped by the secondary transfer device 105, the horizontal registration rollers 2 open.

After the image is transferred onto the sheet P from the transfer belt 104, the sheet P is conveyed by the conveying device 106 to the fixing device 107. After the image is fixed onto the sheet P, the sheet P is ejected outside the main unit of the image forming apparatus.

Next, a description is given of the curved sheet conveyance path 8. By making the curved sheet conveyance path 8 have a large curvature radius of 50 mm or more, it is possible to reduce the resistance applied to the sheet 9 in the curved sheet conveyance path 8. As a result, in a case where the sheet 9 is longer than the distance between the stopper 3 and the sheet conveyance path junction A, is thick, has body, and thus generates a large conveyance resistance; this sheet 9 is conveyed via the curved sheet conveyance path 8 to the sheet aligning mechanism 1; and the pair of horizontal registration rollers 2 aligns the conveyance position of the sheet 9, the following effects are achieved. That is, such a configuration (i.e., with a large curvature radius) reduces the resistance applied to the rear end of the sheet 9, eliminates fluctuations in the precision in aligning the conveyance position, which fluctuations are caused by differences in length/thickness/rigidity of the sheet 9, and realizes high precision in aligning the conveyance position for a wide variety of sheets.

An embodiment of the present invention has been described by taking as an example a sheet aligning device in a sheet feeding device of an image forming apparatus; however, it is obvious that an embodiment of the present invention is applicable to any general-use printer for preventing a skewed condition or horizontal shifts of a sheet being conveyed.

According to one embodiment of the present invention, a sheet aligning device includes a sheet conveyance path; a detecting unit configured to detect a side edge of a sheet being conveyed in the sheet conveyance path; a stopper provided on an upstream side of the detecting unit and configured to open/close in such a manner as to allow/prevent passage of the sheet through the sheet conveyance path and to position a leading edge of the sheet being conveyed in the sheet conveyance path; a first conveying unit provided on an upstream side of the stopper, the first conveying unit including a pair of first rollers configured to come in contact with/separate from each other; a second conveying unit provided on an upstream side of the first conveying unit, the second conveying unit including a pair of second rollers configured to come in contact with/separate from each other; and a horizontal movement unit configured to move the pair of first rollers in an axial direction of the first rollers based on a detection result output by the detecting unit.

Additionally, in the sheet aligning device, while the first rollers are separated, the second conveying unit conveys the sheet in such a manner that the sheet forms a loop between the stopper and the second conveying unit; after the loop is formed, the first rollers come in contact together, the stopper opens, the second rollers are separated from each other, and while the sheet is being conveyed by the first rollers, the horizontal movement unit moves the first rollers in the axial direction of the first rollers; and after the sheet has passed through the first conveying unit, the horizontal movement unit returns the pair of first rollers to an original position.

Additionally, in the sheet aligning device, a conveyance speed of the second conveying unit is temporarily reduced when the sheet abuts the stopper.

Additionally, in the sheet aligning device, operations of opening/closing the stopper, causing the first rollers to come in contact with/separate from each other, and causing the second rollers to come in contact with/separate from each other, are performed in conjunction with each other by a single driving source.

Additionally, in the sheet aligning device, the operations of opening/closing the stopper, causing the first rollers to come in contact with/separate from each other, and causing the second rollers to come in contact with/separate from each other, are performed by three cams that are fixed to the same camshaft.

Additionally, an image forming apparatus includes the sheet aligning device according to one embodiment of the present invention.

According to one embodiment of the present invention, an image forming apparatus includes a sheet conveyance path; at least one pair of conveying rollers; a pair of feed rollers; a pair of horizontal registration rollers; a stopper configured to correct a skewed condition of a sheet being conveyed in the sheet conveyance path and to open/close in such a manner as to allow/prevent passage of the sheet through the sheet conveyance path; and a detecting unit configured to detect a position of a side edge of the sheet, wherein the pair of conveying rollers, the pair of feed rollers, the pair of horizontal registration rollers, the stopper, and the detecting unit are provided along the sheet conveyance path in the stated order starting from an upstream side of a sheet conveyance direction; and the rollers of each of the pair of conveying rollers, the pair of feed rollers, and the pair of horizontal registration rollers are configured to come in contact with/separate from each other, the image forming apparatus further including a control unit configured to perform horizontal registration correction while the pair of horizontal registration rollers is conveying the sheet after the skewed condition has been corrected by the stopper, the horizontal registration correction being performed based on a detection result output by the detecting unit, the control unit also being configured to control the pair of conveying rollers and the pair of feed rollers, which are provided on an upstream side of the pair of horizontal registration rollers, not to sandwich the sheet at least during the horizontal registration correction.

Additionally, in the image forming apparatus, operations of causing the feed rollers to come in contact with/separate from each other, causing the horizontal registration rollers to come in contact with/separate from each other, and opening/closing the stopper, are performed by three cams that are fixed to the same camshaft.

Additionally, in the image forming apparatus, the horizontal registration correction is performed by causing a cam provided in a main unit of the image forming apparatus to move the horizontal registration rollers in an axial direction of the horizontal registration rollers.

Additionally, in the image forming apparatus, after the horizontal registration correction is completed, the sheet with the corrected skewed condition being conveyed by the pair of horizontal registration rollers is sandwiched by a sheet conveying device provided on a downstream side of the horizontal registration rollers.

Additionally, in the image forming apparatus, the sheet conveyance path between the pair of feed rollers and the pair of horizontal registration rollers substantially extends straight; and a distance between axes of the pair of feed rollers and axes of the pair of horizontal registration rollers falls in a range of 100 mm through 180 mm.

Additionally, the image forming apparatus further includes another sheet conveyance path that merges with said sheet conveyance path at a junction located between the pair of conveying rollers and the pair of feed rollers, wherein the other sheet conveyance path also comprises at least one pair of conveying rollers provided near the junction, which conveying rollers are configured to come in contact with/separate from each other.

Additionally, in the image forming apparatus, the sheet conveyance path between the pair of conveying rollers and the pair of feed rollers substantially extends straight or curves with a curvature radius of 50 mm or more.

The present invention is not limited to the specifically disclosed embodiment, and variations and modifications may be made without departing from the scope of the present invention.

The present application is based on Japanese Priority Patent Application No. 2006-225253, filed on Aug. 22, 2006 and Japanese Priority Patent Application No. 2006-225254, filed on Aug. 22, 2006, the entire contents of which are hereby incorporated by reference.

What is claimed is:

1. A sheet aligning device comprising:

a sheet conveyance path including a camshaft extending in a width direction of the sheet conveyance path;

a stopper including a spindle portion and an arm portion, the arm portion operatively connected to the camshaft and configured to rotate about the spindle portion, the stopper configured to open in such a manner as to allow passage of a sheet through the sheet conveyance path, to close in such a manner as to prevent passage of the sheet through the sheet conveyance path, and to position a leading edge of the sheet being conveyed in the sheet conveyance path to attain an alignment of the sheet;

a detecting unit arranged downstream from the stopper and configured to detect a side edge of the sheet moving past said stopper;

a first conveying unit provided on an upstream side of the stopper, the first conveying unit comprising a pair of first rollers, a first spindle, and a first arm, the first arm operatively connected to the camshaft and at least one of the first rollers, the first arm configured to rotate about the first spindle;

a second conveying unit provided on an upstream side of the first conveying unit, the second conveying unit comprising a pair of second rollers, a second spindle, and a second arm, the second arm operatively connected to the camshaft and at least one of the second rollers, the second arm configured to rotate about the second spindle, the second rollers configured to come together to contact the sheet and to separate from each other to release the sheet;

a horizontal movement unit configured to move the pair of first rollers in an axial direction of the first rollers based on a detection result output by the detecting unit while maintaining the alignment of the sheet, wherein the camshaft, stopper, first conveying unit, and second conveying unit are configured such that a rotation of the camshaft translates to a rotation of the arm portion of the stopper, the first arm of the first conveying unit, and the second arm of the second conveying unit, which translates to a displacement of the stopper, the first rollers, and the second rollers, and a control unit configured to control the first conveying unit, the second conveying unit, the stopper, the horizontal movement unit, and the camshaft to perform a sheet alignment operation wherein:

the first rollers are separated from each other and the second conveying unit conveys a sheet such that the sheet forms a loop between the stopper and the second conveying unit;

wherein, after the loop is formed, the first rollers are brought together to contact the sheet, the stopper is opened, and the second rollers are separated from each other to release the sheet;

wherein the first rollers convey the sheet to the detecting unit and, after the sheet is detected by the detecting unit, the horizontal movement unit moves the first rollers, from an original position, in the axial direction of the first rollers while the sheet is being conveyed by the first rollers based on a detection result output by the detecting unit;

wherein the first rollers are separated from each other to release the sheet after the first rollers and sheet are moved by the horizontal movement unit, and the first rollers are moved back to the original position by the horizontal movement unit; and when the first rollers are returned to the original position, the first rollers are brought together to contact and further convey the sheet.

2. The sheet aligning device according to claim 1, wherein:

operations of opening and closing the stopper, causing the first rollers to come in contact with and separate from each other, and causing the second rollers to come in contact with and separate from each other, are performed in conjunction with each other by a single driving source.

3. The sheet aligning device according to claim 2, wherein:

the operations of opening and closing the stopper, causing the first rollers to come in contact with and separate from each other, and causing the second rollers to come in contact with and separate from each other, are performed by three cams that are fixed to the camshaft.

4. The sheet aligning device according to claim 1, wherein:

a conveyance speed of the second conveying unit is temporarily reduced when the sheet abuts the stopper.

5. An image forming apparatus comprising the sheet aligning device according to claim 1.

6. The sheet aligning device according to claim 1, wherein:

the horizontal movement unit includes a cam that rotates to move the pair of first rollers in the axial direction.

7. The sheet aligning device according to claim 1, wherein:

after the pair of first rollers are moved by the horizontal movement unit, the sheet being conveyed by the pair of first rollers is sandwiched by a sheet conveying device provided on a downstream side of the pair of first rollers.

8. The sheet aligning device according to claim 1, wherein:

the sheet conveyance path between the pair of second rollers and the pair of first rollers extends in a substantially straight direction; and a distance between axes of the pair of second rollers and axes of the pair of first rollers falls in a range of 100 mm through 180 mm.

9. The sheet aligning device according to claim 1, further comprising:

two other sheet conveyance paths provided on an upstream side of the second conveying unit, wherein:

each of the two other sheet conveyance paths includes a third conveying unit having a pair of third rollers configured to come together to contact the sheet and to separate from each other to release the sheet; and the two other sheet conveyance paths merge together at a junction located between the pairs of third rollers and the pair of second rollers.

10. The sheet aligning device according to claim 1, further comprising:

another sheet conveyance path provided on an upstream side of the second conveying unit, wherein:

the other sheet conveyance path extends in a substantially straight direction or curves with a curvature radius of 50 mm or more.

11. The sheet aligning device according to claim 1, wherein the detecting unit is a linear image sensor configured to measure a shift amount of the side edge of the sheet from a reference position, and the horizontal movement unit is configured to move the sheet by an amount corresponding to the shift amount of the side edge of the sheet from the reference position detected by the detecting unit.

12. The sheet aligning device according to claim 1, wherein the detecting unit includes two sensors arranged side by side along a conveying direction of the sheet, the two sensors being disposed across a reference position of the side edge of the sheet, and the horizontal movement unit is configured to move the sheet such that an output of one of the two sensors is turned on and an output of the other of the two sensors is turned off.

13. The sheet aligning device according to claim 1, wherein opening and closing the stopper, causing the first rollers to come in contact with and separate from each other, and causing the second rollers to come in contact with and separate from each other are effectuated by the camshaft, the camshaft arranged between the first conveying unit and the second conveying unit.

14. The sheet aligning device according to claim 1, wherein the horizontal movement unit is configured to shift the sheet by a correction amount calculated from the detection result output.

15. The sheet aligning device according to claim 1, wherein the horizontal movement unit is configured to shift the sheet in one direction based on the detection result output.

16. The sheet aligning device according to claim 1, wherein the camshaft is disposed between the arm portion of the stopper and the second arm of the second conveying unit.

17. A sheet aligning device comprising:

a sheet conveyance path including a camshaft extending in a width direction of the sheet conveyance path;

a first cam, a second cam, and a third cam mounted on the camshaft such that a rotation of the camshaft results in a simultaneous rotation of the first, second, and third cams;

a stopper including a spindle portion and an arm portion, the arm portion configured to cyclically engage the third cam so as to rotate about the spindle portion and cause the stopper to open to allow passage of a sheet through the sheet conveyance path and to subsequently close to prevent passage of the sheet through the sheet conveyance path and to allow a positioning of a leading edge of the sheet being conveyed in the sheet conveyance path to attain an alignment of the sheet;

a detecting unit arranged downstream from the stopper and configured to detect a side edge of the sheet moving past said stopper;

a first conveying unit provided on an upstream side of the stopper, the first conveying unit comprising a pair of first rollers, a first spindle, and a first arm, the first arm operatively connected to at least one of the first rollers, the first arm configured to cyclically engage the first cam so as to rotate about the first spindle and cause the first rollers to separate from each other to release the sheet and to subsequently come together to contact the sheet;

a second conveying unit provided on an upstream side of the first conveying unit, the second conveying unit comprising a pair of second rollers, a second spindle, and a second arm, the second arm operatively connected to at least one of the second rollers, the second arm configured to cyclically engage the second cam so as to rotate about the second spindle and cause the second rollers to separate from each other to release the sheet and to subsequently come together to contact the sheet; and a horizontal movement unit configured to move the pair of first rollers in an axial direction of the first rollers based on a detection result output by the detecting unit while maintaining the alignment of the sheet, wherein the sheet aligning device is configured such that a cycle of the rotation of the camshaft includes a first phase, a second phase, a third phase, a fourth phase, and a fifth phase, wherein a third phase of the cycle includes the arm portion of the stopper engaging the third cam, the first arm of the first conveying unit not engaging the first cam, and the second arm of the second conveying unit engaging the second cam, the side edge of the sheet being detected by the detecting unit during the third phase and the horizontal movement unit configured to move the pair of first rollers from an original position to a shifted position in the axial direction based on the detection result.

18. The sheet aligning device according to claim 17, wherein the first phase of the cycle includes the arm portion of the stopper not engaging the third cam, the first arm of the first conveying unit engaging the first cam, and the second arm of the second conveying unit not engaging the second cam, the leading edge of the sheet being conveyed in the sheet conveyance path through the first rollers to the stopper to attain the alignment during the first phase.

19. The sheet aligning device according to claim 17, wherein the second phase of the cycle includes the arm portion of the stopper not engaging the third cam, the first arm of the first conveying unit not engaging the first cam, and the second arm of the second conveying unit not engaging the second cam, the sheet being contacted by the first rollers during the second phase after attaining the alignment.

20. The sheet aligning device according to claim 17, further comprising:

a control unit configured to control a horizontal movement of the first rollers by the horizontal movement unit during the third phase.

21. The sheet aligning device according to claim 17, wherein the fourth phase of the cycle includes the arm portion of the stopper engaging the third cam, the first arm of the first conveying unit engaging the first cam, and the second arm of the second conveying unit engaging the second cam, the horizontal movement unit configured to move from the shifted position to the original position during the fourth phase.

22. The sheet aligning device according to claim 17, wherein the fifth phase of the cycle includes the arm portion of the stopper engaging the third cam, the first arm of the first conveying unit engaging the first cam, and the second arm of the second conveying unit not engaging the second cam, the second rollers configured to come together in preparation for a receipt of a subsequent sheet during the fifth phase.

* * * * *